US005497790A

United States Patent [19]

Fujishige

[11] Patent Number: 5,497,790

[45] Date of Patent: Mar. 12, 1996

[54] CUT TOBACCO LAYER TRIMMING APPARATUS FOR A CIGARETTE MANUFACTURING MACHINE

[75] Inventor: Masaru Fujishige, Takamatsu, Japan

[73] Assignee: Japan Tobacco Inc., Tokyo, Japan

[21] Appl. No.: 203,402

[22] Filed: Mar. 1, 1994

[30] Foreign Application Priority Data

Mar. 4, 1993 [JP] Japan ..... 5-043593

[51] Int. Cl.[6] ..... A24C 5/28

[52] U.S. Cl. ..... 131/84.4

[58] Field of Search ..... 131/84.1, 84.4

[56] References Cited

U.S. PATENT DOCUMENTS

| | | | |
|---|---|---|---|
| 3,604,429 | 9/1971 | De Witt . | |
| 3,604,430 | 9/1971 | Norwich et al. . | |
| 3,742,795 | 7/1973 | Lipcon et al. . | |
| 4,304,243 | 12/1981 | Seragnoli | 131/84.4 |
| 4,598,719 | 7/1986 | Mattei et al. | 131/84.1 |
| 4,600,020 | 7/1986 | Mattei et al. | 131/84.4 |
| 4,653,516 | 3/1987 | Mattei | 131/84.1 X |
| 5,003,996 | 4/1991 | Tallier et al. | 131/84.4 X |

FOREIGN PATENT DOCUMENTS

| | | |
|---|---|---|
| 0011510 | 5/1980 | European Pat. Off. . |
| 3631227 | 3/1988 | Germany . |
| 51-17200 | 5/1976 | Japan . |
| 2137473 | 10/1984 | United Kingdom . |

*Primary Examiner*—Jennifer Bahr

*Attorney, Agent, or Firm*—Birch, Stewart, Kolasch & Birch

[57] ABSTRACT

A trimming apparatus for a cigarette manufacturing machine has a pair of trimming disks for trimming a cut tobacco layer formed on a tobacco band by rotating, each disk having a plurality of pockets on its peripheral edge, and a synchronizing device in a power transmission line which leads to the disks. The synchronizing device can adjust a rotational phase of the pockets of the trimming disks in accordance with the cutting timing for a formed cigarette rod during operation of the cigarette manufacturing machine.

4 Claims, 8 Drawing Sheets

CUT TOBACCO LAYER TRIMMING APPARATUS FOR A CIGARETTE MANUFACTURING MACHINE

BACKGROUND OF THE INVENTION

1. Field of the Invention

The present invention relates to an apparatus for trimming a layer of cut tobacco formed on a tobacco band of a cigarette manufacturing machine, and more particularly, to a trimming apparatus for intermittently increasing the thickness of the cut tobacco layer in the traveling direction of the tobacco band.

2. Description of the Related Art

In a cigarette manufacturing machine, a layer of cut tobacco is first formed on a tobacco band running in one direction. Then, the cut tobacco layer on the tobacco band is adjusted to a predetermined thickness by means of a trimming apparatus, and is fed from the tobacco band onto a paper web traveling in the one direction. As the paper web travels in this manner, the tobacco layer thereon is wrapped in the web, thereby forming a continuous cigarette rod. As the cigarette rod passes through a cutting section of the cigarette manufacturing machine at a predetermined traveling speed, it is cut into individual cigarettes with a given length.

In order to prevent the cut tobacco from falling off from the cut ends of each cigarette, the tobacco filling density of those portions of the cigarette rod in which the rod is to be cut is made higher than that of the other portions.

To attain this, the trimming apparatus has a function to increase intermittently the filling density of the cut tobacco in the cigarette rod to be formed, along the axis of the rod. An example of the trimming apparatus of this type is described in Japanese Patent Publication (KOKOKU) No. 51-17200.

This disclosed trimming apparatus comprises a pair of trimming disks. The disks are arranged right under the tobacco band with their respective peripheral surfaces in rolling contact with each other so that they are rotated in opposite directions. As the cut tobacco layer, along with the tobacco band, passes the pair of trimming disks, therefore, a surplus of the tobacco layer is scraped off by the rotating disks, whereby the thickness of the tobacco layer is made uniform.

However, each trimming disk has a plurality of pockets on its peripheral edge, and each pocket of one disk and its corresponding pocket of the other disk cyclically meet each other right under the tobacco band as the disks rotate. Thus, the thickness of the cut tobacco layer on the tobacco band is not uniform with respect to the traveling direction, and is increased by a margin equivalent to the depth of each pocket every time the corresponding pockets of the pair of trimming disks meet just under the tobacco band. In consequence, the cut tobacco layer fed from the tobacco band onto the paper web has first regions of high tobacco density and second regions of low tobacco density which are arranged alternately in the traveling direction of the web.

When the cut tobacco layer on the paper web is wrapped in the web to form a continuous cigarette rod, thereafter, the filling density of the cut tobacco in those portions of the rod which correspond to the first regions is naturally higher than that of those portions which correspond to the second regions. If the cigarette rod is cut in the respective centers of specific portions corresponding to the first regions, therefore, the cut tobacco can be prevented from falling off from the cut ends of individual cigarettes, since the filling density of the tobacco is higher in the vicinity of the cut ends.

As is evident from the above description, each specific portion in which the cigarette rod is to be cut must be formed for each interval which is as long as each cigarette, and the cigarette rod must be cut accurately in the center of each specific portion. Therefore, the cigarette rod must be cut in synchronism with the phase of advance of the specific portions thereof, that is, the rotational phase of the pockets of the trimming disks.

If the operation of the cigarette manufacturing machine goes wrong, or if troubleshooting is carried out, the cutting timing for the cigarette rod and the rotational phase of the pockets of the trimming disks may fail to be synchronous due to some cause.

In this case, the rotational phase of the pockets of the trimming disks should be adjusted in order to re-establish the synchronism between the cutting timing and the rotational phase. This adjustment must, however, be made after stopping the operation of the cigarette manufacturing machine. To check the adjustment for accuracy, moreover, the manufacturing machine requires a trial run. Accordingly, adjusting the rotational phase of the pockets of the trimming disks to the cutting timing for the cigarette rod takes a lot of time, thus considerably lowering the operating efficiency of the cigarette manufacturing machine.

SUMMARY OF THE INVENTION

The object of the present invention is to provide a trimming apparatus capable of adjusting the rotational phase of pockets of trimming disks to the cutting timing for a cigarette rod without stopping the operation of a cigarette manufacturing machine.

The above object is achieved by a trimming apparatus according to the present invention, which comprises: a trimming disk arranged for rotation under a tobacco band of a cigarette manufacturing machine, the trimming disk having a plurality of pockets on the peripheral edge portion thereof such that each pocket cyclically passes right under the tobacco band as the trimming disk rotates, whereby the trimming disk trims a cut tobacco layer traveling together with the tobacco band, the pockets forming thickened portions in the cut tobacco layer at intervals each corresponding to the length of each of the cigarettes, the thickness of the thickened portions being greater than that of the other portions of the cut tobacco layer; drive means for rotating the trimming disk, the drive means including a power transmission line extending up to the trimming disk; and synchronizing means for synchronizing a rotational phase of the pockets of the trimming disk with cutting signals from a cutting section during operation of the cigarette manufacturing machine, whereby a formed cigarette rod is cut in the respective centers of specific portions corresponding individually to the thickened portions of the cut tobacco layer.

According to the trimming apparatus described above, if cutting positions of the cigarette rod are deviated from the centers of the specific portions thereof during the operation of the cigarette manufacturing machine, the synchronizing means adjusts the rotational phase of the pockets of the trimming disk, so that a cigarette rod can be cut accurately in the centers of the specific portions. Since this adjustment is made during the operation of the cigarette manufacturing machine, the operating efficiency of the machine cannot be lowered.

The synchronizing means may include an input shaft located in the power transmission line of the drive means and receiving power, an output shaft for delivering the power to the trimming disk, planetary gear means for transmitting the rotation of the input shaft to the output shaft, and adjusting means for changing a rotational phase of the output shaft with respect to that of the input shaft.

When the input shaft is rotated, in this case, the rotational input of the input shaft is transmitted to the output shaft through the planetary gear means, and the output shaft causes the trimming disk to rotate at a predetermined peripheral speed.

In the case where the input and output shafts are arranged on a axis, the planetary gear means includes a disk-shaped carrier mounted on the input shaft, a sun gear mounted on the output shaft, a ring gear surrounding the sun gear and supported for rotation, the ring gear having internal teeth, a plurality of gear shafts projecting from the carrier and extending in a space between the sun gear and the ring gear, and a plurality of planetary gears mounted individually on the gear shafts for rotation and in mesh with the sun gear and the internal teeth of the ring gear, and the adjusting means includes second drive means for rotating the ring gear in a forward or reverse direction.

When the input shaft is rotated, in this case, the rotational phase of the output shaft, that is, the rotational phase of the pockets of the trimming disk, is adjusted with respect to that of the input shaft.

The ring gear can be rotated manually or automatically in accordance with the cutting timing for the cigarette rod.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENT

Figure 1:
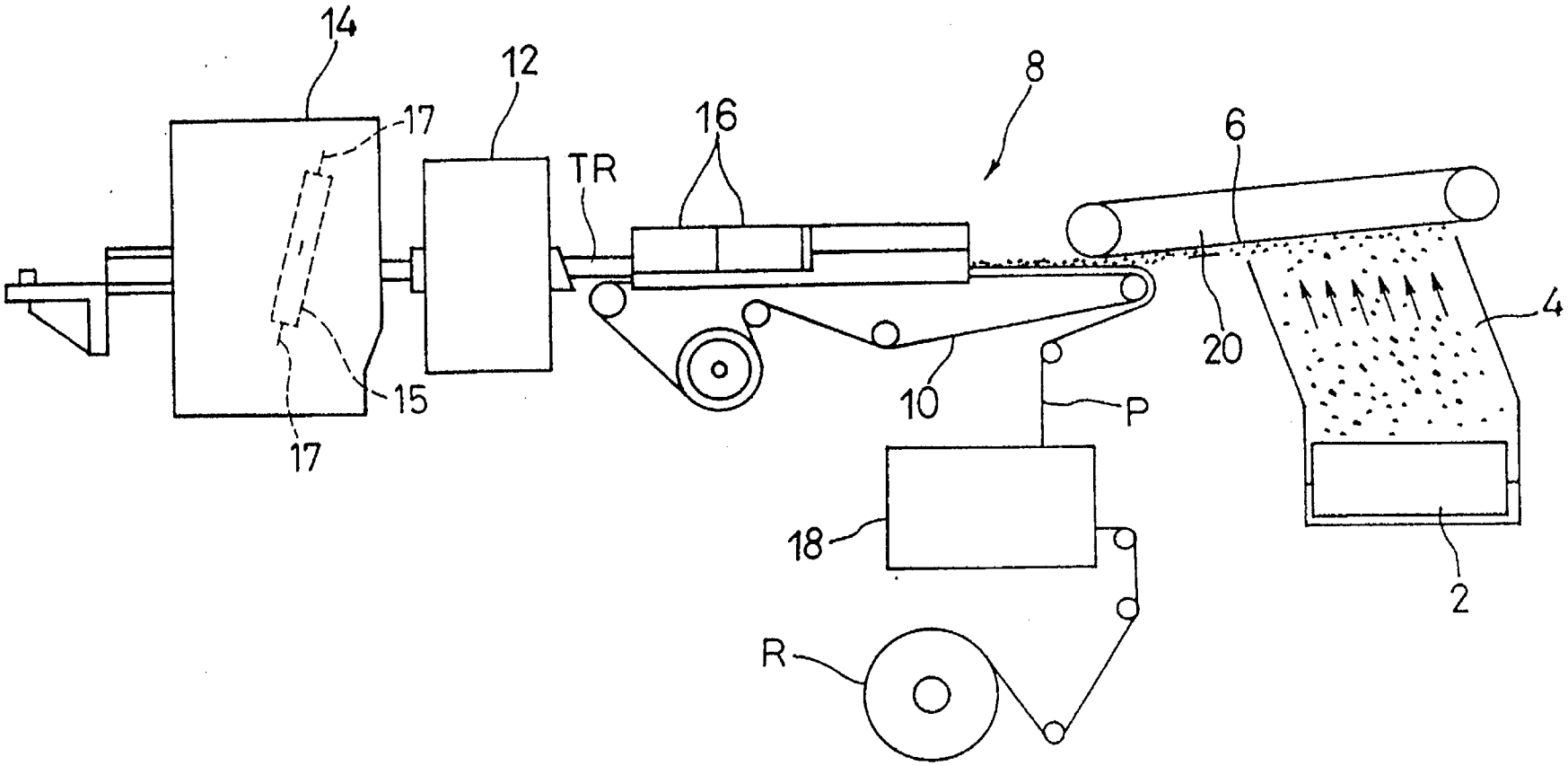
FIG. 1 is a diagram schematically showing a cigarette manufacturing machine.

A cigarette manufacturing machine shown in FIG. 1 comprises a chimney 4. An introduction drum 2 is located for rotation in the lower part of the chimney 4, and a tobacco band 6 is arranged right over the chimney 4. The tobacco band 6, which is formed of an endless suction belt, extends up to a wrapping section 8 of the cigarette manufacturing machine.

As the introduction drum 2 rotates, cut tobacco is fed into the chimney 4. The cut tobacco ascends in the chimney 4 toward the tobacco band 6, and is attracted in a layer to the lower surface of the band 6. As the tobacco band 6 travels, the cut tobacco layer thereon is fed toward the wrapping section 8.

The terminal of the tobacco band 6 is situated over the wrapping section 8. The wrapping section 8 is furnished with an endless garniture tape 10, which travels in one direction. The tape 10 is supplied with a paper web P. The paper web P is lapped on the garniture tape 10, and travels together with the tape 10. The paper web P is delivered from a roll R, passes through a printing section 18, and is then fed toward the wrapping section 8.

The cut tobacco layer on the tobacco band 6 is fed from the band 6 onto the paper web P in the wrapping section 8. As the paper web P travels together with the garniture tape 10, the cut tobacco layer on the web P is wrapped therein, whereupon a cigarette rod TR is continuously formed. Paste is applied to one side edge of the paper web P, and both side edges of the web are lapped on each other to be pasted together.

As the formed cigarette rod TR passes right under a pair of dryers 16 in the wrapping section 8, its pasted portion is dried, whereupon the rod TR is delivered from the section 8.

Thereafter, the cigarette rod TR is fed to a cutting section 14 through an inspection section 12. The cutting section 14 has a cutting disk 15 therein, and a plurality of cutting knives 17 are mounted on the outer peripheral surface of the disk 15. As the cutting disk 15 rotates, the cigarette rod TR passing through the cutting section 14 is cut into individual cigarettes with a predetermined length by the cutting knives 17. These cigarettes are discharged from the cutting section 14 into a tray (not shown).

The inspection section 12 contains a density sensor, which continuously detects a filling density of the cut tobacco in the cigarette rod TR passing through the section 12. Detection signal from the density sensor is utilized for controlling the quantity of the cut tobacco to be filled in the cigarette rod TR, or more specifically, a trimming apparatus.

Figure 2:
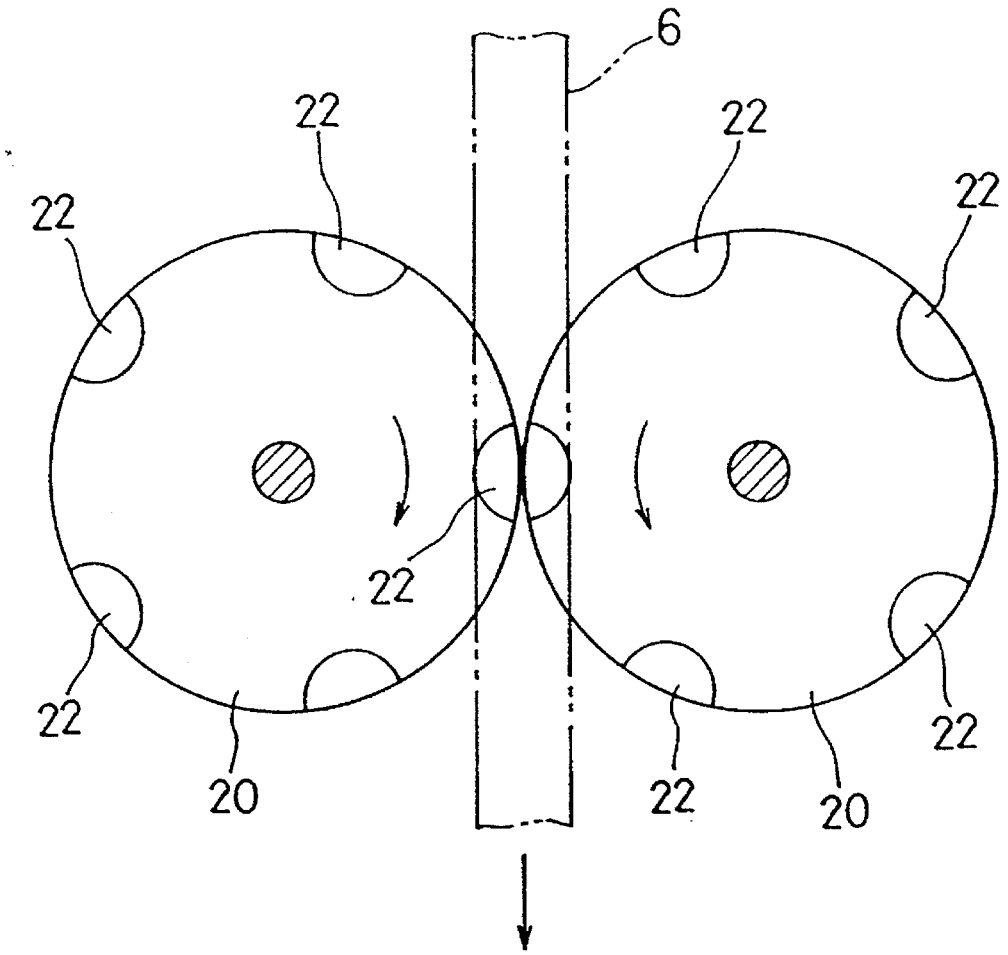
FIG. 2 is a plan view showing a pair of trimming disks of FIG. 1.
Figure 3:
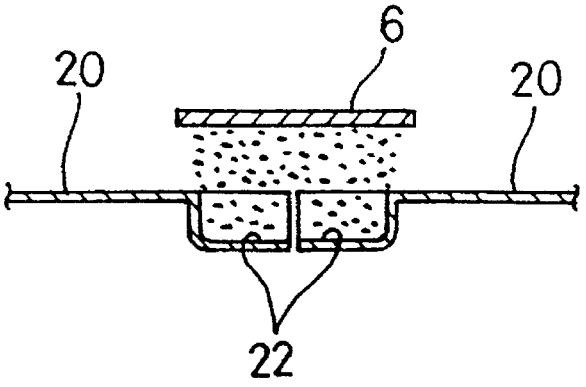
FIG. 3 is a sectional view showing part of the trimming disks.

The trimming apparatus comprises a pair of trimming disks 20, which are arranged under that portion of the tobacco band 6 which is situated between the chimney 4 and the wrapping section 8. More specifically, as seen from FIGS. 2 and 3, the trimming disks 20 are located on either side of the tobacco band 6 so that they are in rolling contact with each other right under the band 6.

Each trimming disk 20 has a plurality of pockets 22 on its peripheral edge. The pockets 22 are arranged at regular intervals in the circumferential direction of the disk 20. The paired trimming disks 20 are rotated in opposite directions, as indicated by the arrows in FIG. 2. Each pocket 22 of one trimming disk 20 and its corresponding pocket 22 of the other trimming disk 20 cyclically meet each other right under the tobacco band 6, and the met pockets 20 move in the traveling direction of the band 6.

As the cut tobacco layer on the tobacco band 6 passes the pair of trimming disks 20, a surplus of the tobacco layer is scraped off by the rotating disks 20. Thus, the thickness of the cut tobacco layer depends on the distance between the tobacco band 6 and each disk 20.

Since the paired pockets 22 cyclically meet each other right under the tobacco band 6 while the trimming disks 20 are rotating, a quantity of cut tobacco corresponding to the respective capacities of these pockets 22 cannot be removed. As a result, thickened portions are formed at regular pitches in the cut tobacco layer having passed the trimming disks 20. The pitch of the thickened portions of the tobacco layer is equal to the length of each manufactured cigarette.

When the cigarette rod TR is formed from the trimmed cut tobacco layer and the paper web P in the aforesaid manner, specific portions corresponding to the thickened portions of the tobacco layer are formed at regular pitches in the rod TR. The filling quantity of the cut tobacco in these specific portions is higher than that of the tobacco in any other portions of the cigarette rod. Thus, the cigarette rod TR is cut in the center of each specific portion in the cutting section 14.

Figure 4:
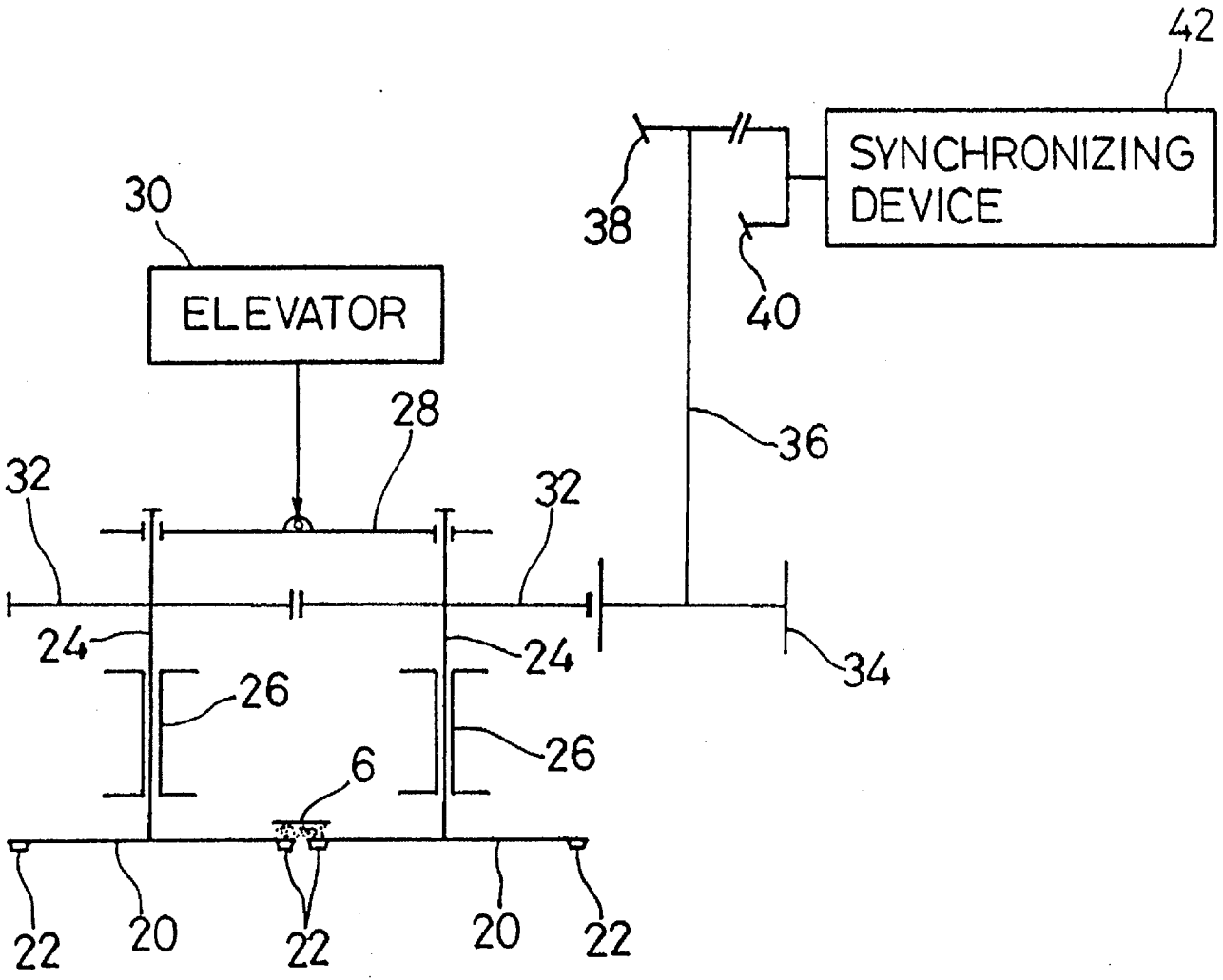
FIG. 4 is a diagram showing a power transmission line between the trimming disks and a drive source.

Referring to FIG. 4, there is schematically shown a power transmission line of the trimming apparatus. Each trimming disk 20 has a rotating shaft 24, which slidably extends upward through a guide sleeve 26. The respective upper ends of the shafts 24 are coupled to a bar 28, which is connected to an elevator 30. The elevator 30 raises and lowers the pair of trimming disks 20 by means of the bar 28.

A pair of gears 32 are mounted individually on the rotating shafts 24. The gears 32 are situated between the bar 28 and the guide sleeve 26, and are in mesh with each other. Moreover, a gear 34 is in mesh with one of the gears 32. Having a greater face width than that of each gear 32, the gear 34 is mounted on the lower end of a transmission shaft 36. The shaft 36 extends upward, and its upper end is connected to an output shaft of a synchronizing device 42 through a pair of bevel gears 38 and 40. The device 42 has an input shaft which is connected to a drive source side.

Power from the synchronizing device 42 is transmitted to the paired gears 32 via the bevel gears 38 and 40, transmission shaft 36, and gear 34, whereby the trimming disks 20 are rotated in the opposite directions in the aforementioned manner.

The peripheral speed of each trimming disk 20 is set in accordance with the traveling speed of the tobacco band 6, that is, the traveling speed of the formed cigarette rod TR. The rotational phase of the pockets 22 of the disks 20 is synchronous with the cutting timing for the cigarette rod TR, so that the rod TR is cut in the center of each specific portion thereof in the cutting section 14.

The filling quantity of cut tobacco for each unit length of the cigarette rod TR is measured in accordance with the detection signal from the aforesaid density sensor, and the elevator 30 is operated on the basis of the measured quantity. More specifically, the elevator 30 causes the bar 28 to move the pair of trimming disks 20 up or down in accordance with the measured quantity of cut tobacco, thereby adjusting the distance between the tobacco band 6 and the trimming disks 20, that is, the thickness of the cut tobacco layer on the band 6. As a result, the filling quantity of cut tobacco for each unit length of the cigarette rod TR to be formed is uniform, so that the individual cigarettes can enjoy reliable quality.

Figure 5:
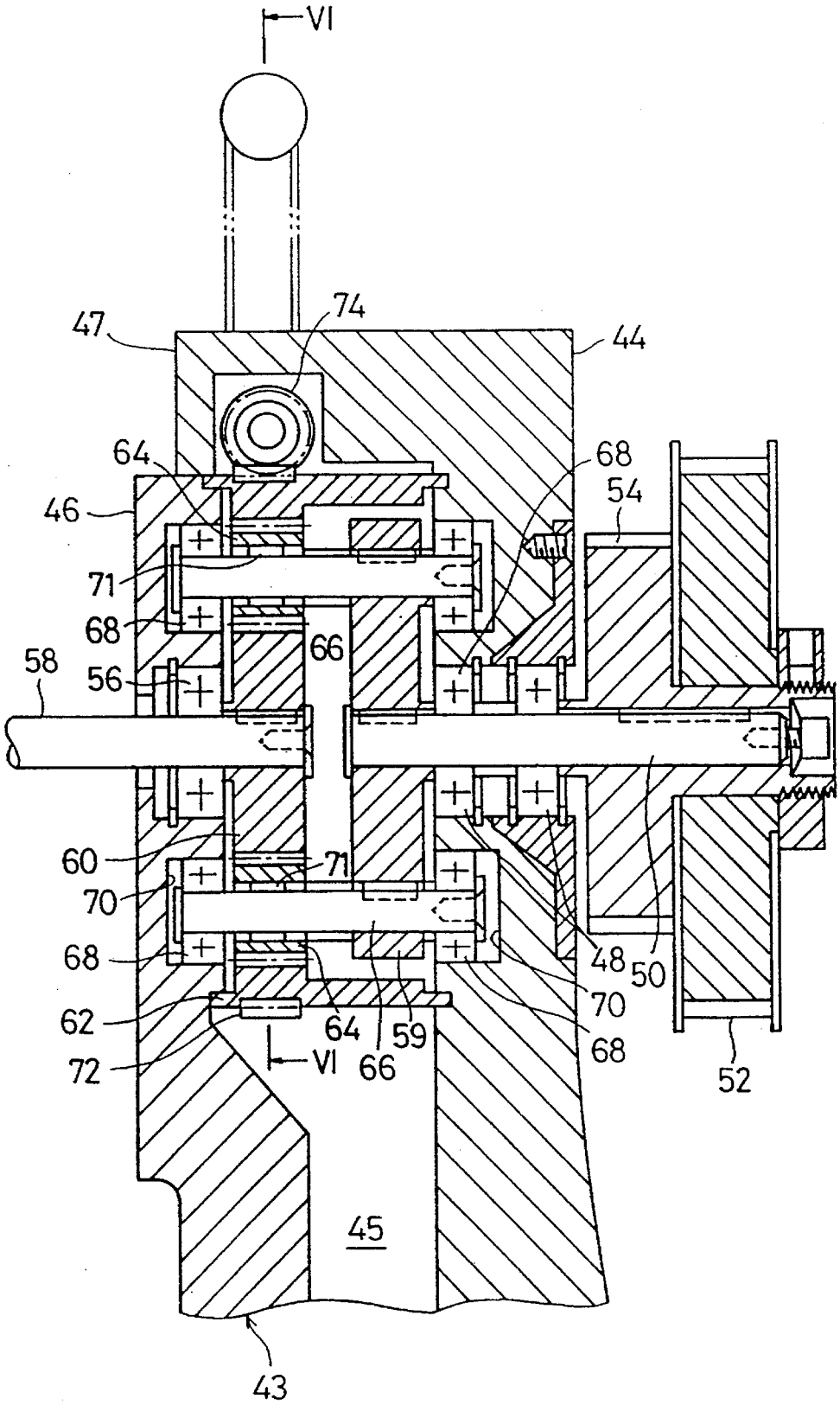
FIG. 5 is a vertical sectional view showing a synchronizing device according to one embodiment of the present invention.
Figure 6:
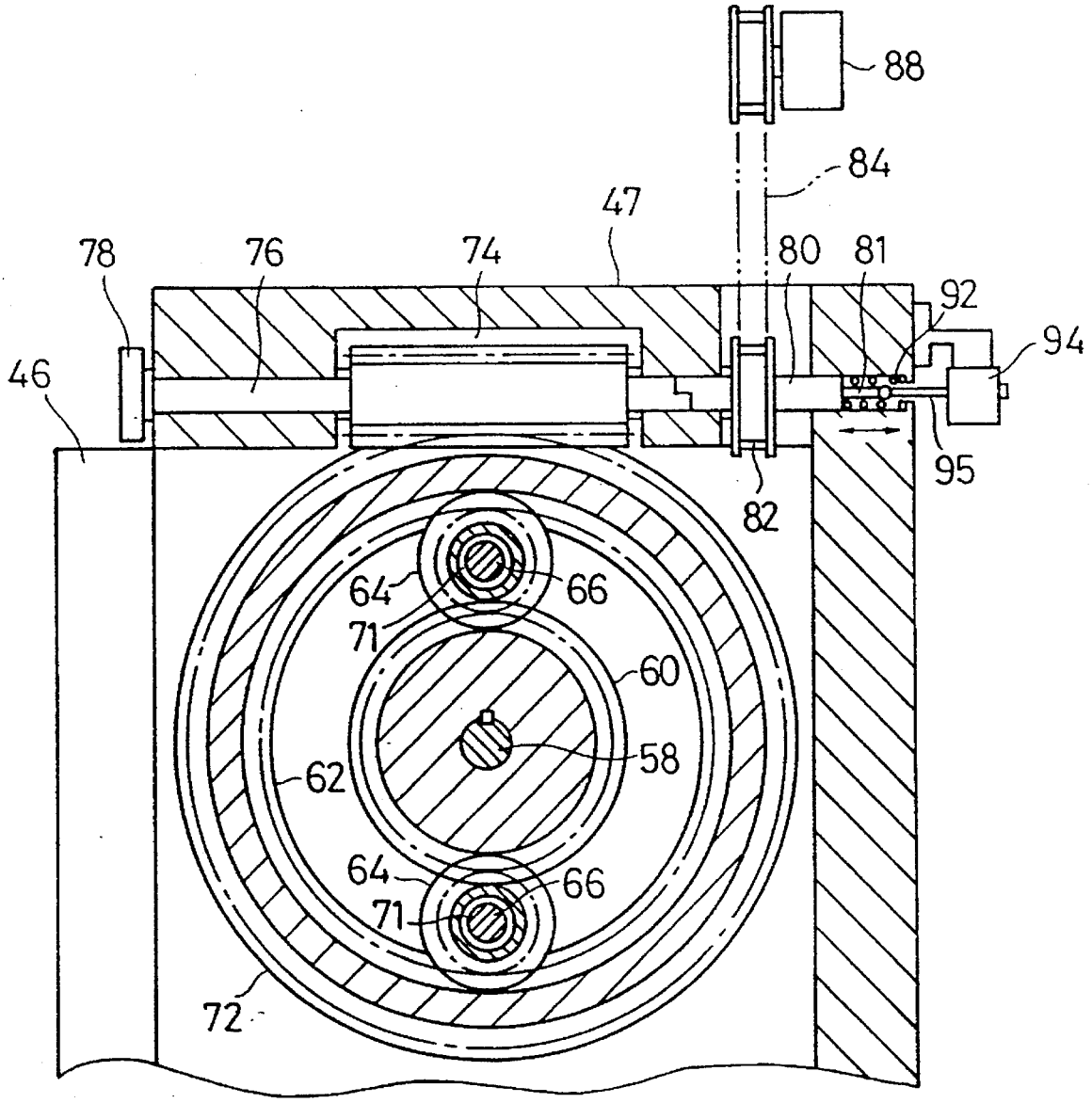
FIG. 6 is a sectional view taken along line VI—VI of FIG. 5.

Referring now to FIGS. 5 and 6, the synchronizing device 42 will be described.

The synchronizing device 42 comprises a housing 43. The housing 43 includes a pair of shells 44 and 46, which define a gear chamber 45 in the housing 43. The housing shells 44 support the input shaft 50 with the aid of a pair of bearings 48. One end of the shaft 50 projects into the gear chamber 45, and the other end outside the housing 43. A pair of toothed pulleys 52 and 54 are mounted on the other end of the shaft 50. The one pulley 52 is connected to the drive source or the main-shaft side of the cigarette manufacturing machine by means of a gear belt (not shown). Thus, the input shaft 50 is rotated at constant speed by means of a driving force from the main shaft.

The other toothed pulley 54 is connected to a driving pulley for the tobacco band 6 by means of a gear belt (not shown). Thus, the driving force from the main shaft of the main shaft is also transmitted to the tobacco band 6 through the input shaft 50, so that the band 6 travels at constant speed.

The shell 46 supports the output shaft 58 with the aid of a bearing 56. The shaft 58 is coaxial with the input shaft 50. One end of the output shaft 58 projects into the gear chamber 45, and the other end outside the housing 43. The bevel gear 40 (see FIG. 4) is mounted on the other end of the output shaft 58.

A disk-shaped carrier 59 is mounted on the one end of the input shaft 50 by means of a key, while a sun gear 60 is fitted on the one end of the output shaft 58 by means of another key.

The sun gear 60 is surrounded by a ring gear 62, which has internal teeth. The ring gear 62 is rotatably supported by both of the shells 44 and 46.

Annular grooves 70 are formed individually in the respective inner surfaces of the shells 44 and 46 facing each other so as to be concentric with the input and output shafts 50 and 58.

A pair of gear shafts 66 are attached to the peripheral edge portion of the carrier 59 by means of keys. The shafts 66, which are spaced in the diametrical direction of the carrier 59, extend into the annular groove 70 of the shell 46 through a space between the sun gear 60 and the ring gear 62. One end of each gear shaft 66 is situated in the groove 70 of the shell 46, and is supported by the shell 46 with the aid of a bearing roller 68. Likewise, the other end of each gear shaft 66 extends into the annular groove 70 of the shell 44, and is supported by the shell 44 with the aid of a bearing roller 68.

When the carrier 59 is rotated together with the input shaft 50, both ends of each gear shaft 68 move guided by their corresponding annular grooves 70.

A planetary gear 64 is mounted on each gear shaft 66 with the aid of a bearing 71. The gears 64 are in mesh with the sun gear 60 and the internal teeth of the ring gear 62.

By the agency of the gear system described above, the carrier 59 is rotated as the input shaft 50 is rotated. The pair of planetary gears 64, mounted individually on the gear shafts 66 of the carrier 59, move around the sun gear 60 in a manner such that they are in mesh the gear 60 and the internal teeth of the ring gear 62, thereby causing the sun gear 60 or the output shaft 58 to rotate.

If the numbers of teeth of the sun gear 60, each planetary gear 64, and the ring gear 62 are 80, 20 and 40, respectively, each planetary gear 64 makes four revolutions on its own axis as it moves once around the sun gear 60. Thus, the sun gear 60 or the output shaft 58 rotates at double the speed of the input shaft 50.

Formed integrally on the outer peripheral surface of the ring gear 62 are teeth which constitute the gear 62 as a worm wheel 72. On the other hand, the shell 44 has an extended portion 47 which covers the ring gear 62 from above. Housed in the extended portion 47 is a worm 74, which is in mesh with the worm wheel 72. As shown in FIG. 6, both ends of a shaft 76 of the worm 74 are rotatably supported by the shell 44.

One end of the worm shaft 76 projects from the shell 44, and an adjusting handle 78 is mounted on this projecting end. One end of an adjusting shaft 80 is separably in engagement with the other end of the worm shaft 76. Both ends of the shaft 80 are rotatably supported by the shell 44.

Further, the adjusting shaft 80 is fitted with a toothed pulley 82, which is situated in an opening in the extended portion 47 of the shell 44. The pulley 82 is connected to a driving pulley 86 by means of-a gear belt 84 which extends through the opening. The pulley 86 is mounted on an output shaft of a servomotor 88.

The other end of the adjusting shaft 80 is subjected to the urging force of a compression coil spring 92 so that the shaft 80 is pressed to the left of FIG. 6. Normally, therefore, the adjusting shaft 80 and the worm shaft 76 are in engagement with each other, and rotate in an integral manner.

A solenoid-type actuator 94 having a rod 95 is mounted on the outer surface of the shell 44. The rod 95 extends into the shell 44, and is connected to a pin 81 which protrudes from the adjusting shaft 80. The rod 95 and the pin 81 are connected for relative rotation, and the rotation of the shaft 80 cannot be transmitted to the rod 95.

When a solenoid of the actuator 94 is excited, the rod 95 contracts, so that the adjusting shaft 80 moves to the right of FIG. 6 to be separated from the worm shaft 76.

Figure 7:
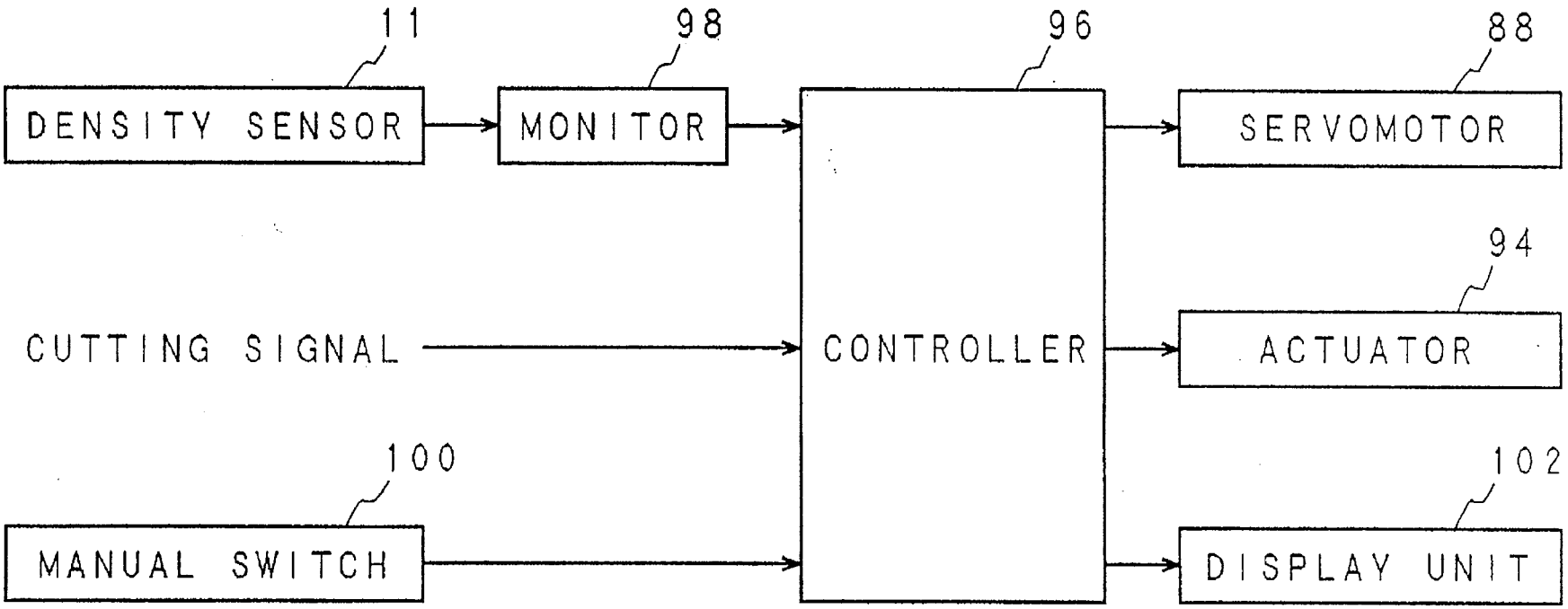
FIG. 7 is a diagram showing a control circuit for controlling a servomotor of the synchronizing device.

As shown in FIG. 7, the servomotor 88 and the actuator 94 are connected electrically to output ports of a controller 96, and a display unit 102, such as a synchroscope, is also connected electrically to the output port of the controller 96. On the other hand, a monitor 98 and a manual switch 100 are connected electrically to input ports of the controller 96. The density sensor 11 is connected electrically to the monitor 98. Moreover, cutting signals from the cutting section 14 are also supplied to an input port of the controller 96.

The monitor 98 measures the filling quantity of the cut tobacco for each unit length of cigarette rod in accordance with the detection signal from the density sensor 11, and delivers quantized signals corresponding to the filling quantity to the controller 96. The unit length is equivalent to the length of each of twenty equal parts or divisions of each cigarette.

The manual switch 100 is used to change the operation of the actuator 94, and switching signals from the switch 100 are supplied to the controller 96. The manual switch 100 is arranged together with other switches, knobs, etc. in a control box of the cigarette manufacturing machine.

The cutting signals supplied to the controller 96 can be generated, for example, in response to pulse signals from a rotary encoder (not shown) which is mounted on the rotating shaft of the cutting disk of the cutting section 14.

The controller 96 includes a microprocessor, memories such as a ROM, RAM, etc., and driver circuits for the servomotor 88 and the actuator 94. The controller 96 controls the servomotor 88 in accordance with programs stored in the memories.

Figure 8:
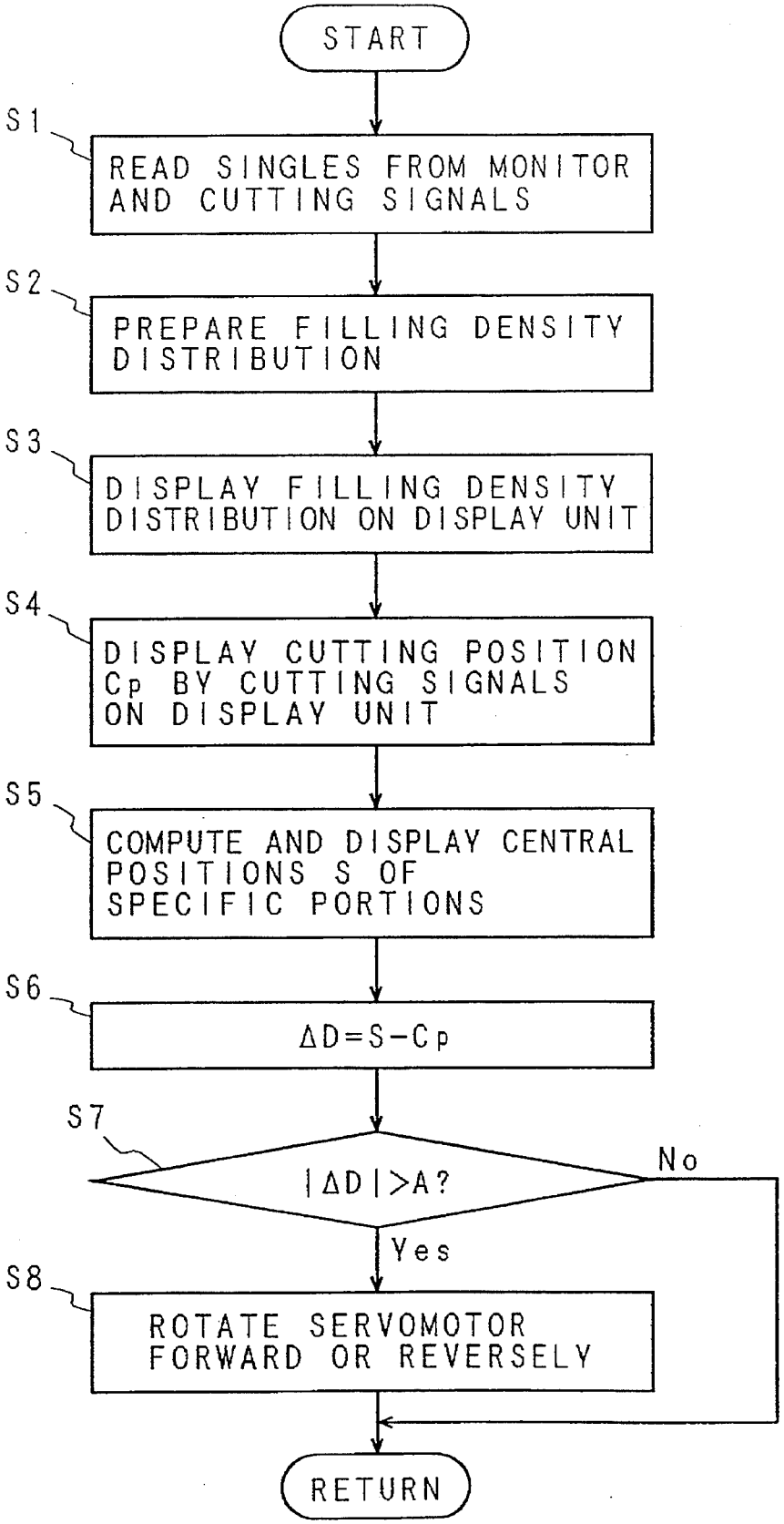
FIG. 8 is a flow chart showing a servomotor control routine executed by a controller shown in FIG. 7.

FIG. 8 shows a control routine executed by the controller 96. Referring now to this control routine, the operation of the controller 96 will be described.

The controller 96 first reads the signals from the monitor 98 and the cutting signals for a given period of time (Step S1). In the controller 96, the averages of filling quantity for the individual divisions of the cigarette rod TR are computed in accordance with the signals from the monitor 98, and the distribution of these averages, that is, filling density distribution DH, is prepared (Step S2).

Figure 9:
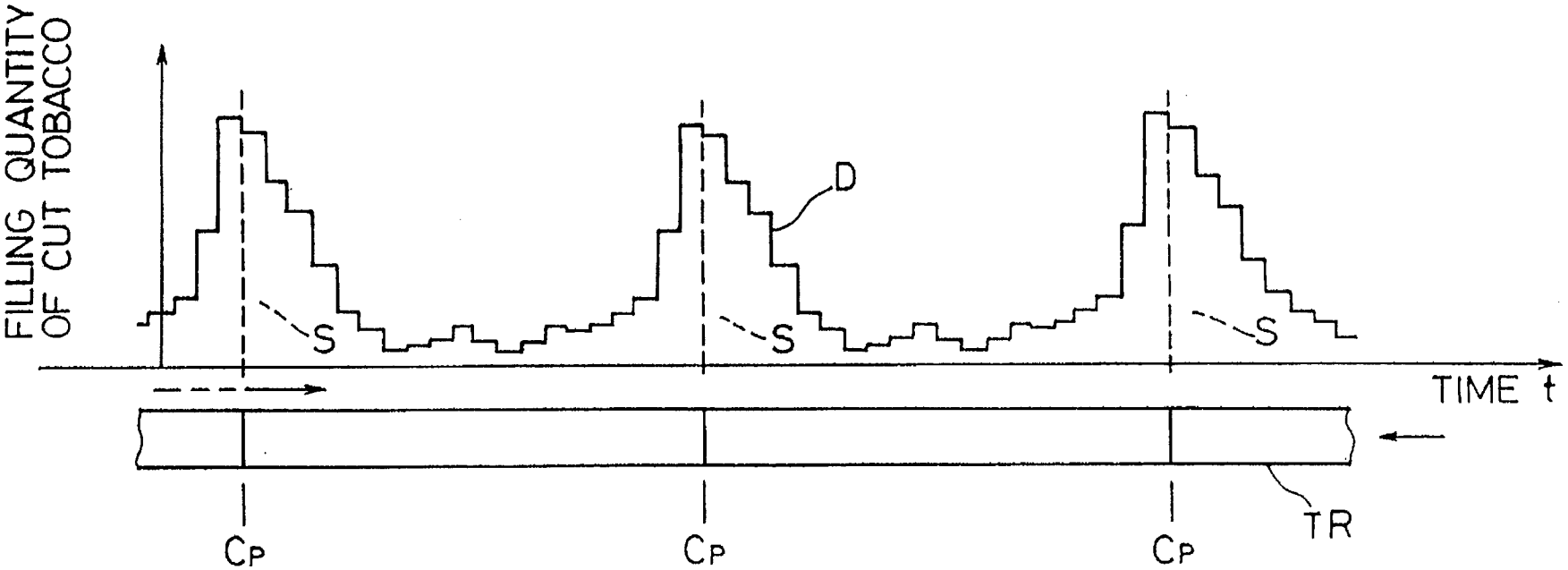
FIG. 9 is a diagram illustrating information displayed on a synchroscope of the control circuit.

Thereafter, the controller 96 displays the prepared filling density distribution DH on the display unit 102, as shown in FIG. 9 (Step S3).

Meanwhile, the controller 96 displays cutting positions Cp of the cigarette rod TR indicated by the cutting signals in association with the filling density distribution DH on the display unit 102 (Step S4).

The controller 96 displays the filling density distribution DH and the cutting positions Cp on the display unit 102 in consideration of the distance between the respective positions of the density sensor 11 and the cutting disk 15. The cutting positions Cp are indicated on a belt which represents the cigarette rod TR.

Then, the controller 96 computes the position of the center of gravity of the six highest-density divisions for each cycle of the filling density distribution DH, and displays this position as a central position S of each specific portion of the cigarette rod TR on the display unit 102 (Step S5). In FIG. 9, each central position S is indicated by broken line.

If the cigarette rod TR is cut accurately in the center of each specific portion thereof in the cutting section 14, as is evident from the above description, each central position S and its corresponding cutting position Cp are aligned on a same axis with respect to the abscissa.

If the central position S is deviated from the cutting position Cp, however, it is concluded that the cigarette rod TR is not cut accurately in the centers of the specific portions.

If the central position S is deviated from the cutting position Cp beyond tolerance in the direction indicated by the broken-line arrow in FIG. 9, then it is concluded that the rotational phase of the pockets 22 of the trimming disks 20 is in advance of the cutting timing. If the central position S is deviated beyond tolerance in the direction indicated by the full-line arrow, in contrast with this, then it is concluded that the rotational phase of the pockets 22 is delayed behind the cutting timing.

Accordingly, the controller 96 computes a distance $\Delta D$ between the central position S and the cutting position Cp (Step S6), and determines whether or not the absolute value of the distance $\Delta D$ is greater than the tolerance A (Step S7). If the decision in Step S7 is YES, the controller 96 delivers a control signal to the servomotor 88, depending on the distance $\Delta D$ and its direction, positive or negative, thereby rotating the servomotor 88 in the forward or reverse direction (Step S8).

Thereupon, the servomotor 88 drives the gear belt 84 to rotate the adjusting shaft 80 or the worm 74. This rotation of the worm 74 is transmitted to the ring gear 62 via the worm wheel 72, whereby the gear 62 is rotated for a given angle in a predetermined direction. This rotation of the ring gear 62 causes the speed of rotation of each planetary gear 64 on its own axis to increase or decrease.

As a result, the rotational phase of the output shaft 58 has a deviation, advance or delay, from that of the input shaft 50, and the distance $\Delta D$ from the cutting position Cp to the central position S can be decreased within the tolerance A. Thus, the central position S is automatically synchronized with the cutting timing.

The synchronizing device 42 according to one embodiment of the present invention may be operated manually as well as by means of the servomotor 88. More specifically, if an operator shifts the manual switch 100 to supply a switching signal from the switch 100 to the controller 96, the controller 96 excites the solenoid of the actuator 94, thereby contracting the rod 95. Accordingly, the adjusting shaft 80 is separated from the worm shaft 76 against the urging force of the compression coil spring 92, so that the shaft 76 or the worm 74 is allowed to be rotated by manually operating the adjusting handle 78.

Thus, the operator can operate the adjusting handle 78 to rotate the ring gear 72 while checking the distance ΔD between the cutting position Cp and the central position S displayed on the display unit 102, thereby synchronizing the central position S with the cutting timing.

This synchronizing operation facilitates automatic or manual adjustment of a deviation, if any, between each cutting position of the cigarette rod TR and the central position of each corresponding specific portion thereof, which is attributable to an abnormal stop of operation of the cigarette manufacturing machine, restoration of the machine conditions, or some other cause. This adjustment can be made without stopping the operation of the machine.

If the cigarette manufacturing machine is provided with the trimming apparatus described herein, the operating efficiency of the machine can be improved considerably, and besides, the cigarette rod TR can be cut accurately. Thus, the incidence of defectives can be lowered substantially and waste of the cut tobacco can be reduced. Since the filling density of the cut tobacco is always high at the cut ends of the cigarettes, moreover, the cut tobacco can be prevented from falling off from the cut ends, so that the quality of the cigarettes can be improved.

The operator can adjust the rotational phase of the pockets 22 of the trimming disks 20 while observing the display on the display unit 102. Therefore, this adjustment can be easily made in a short period of time, and its accuracy hardly depends on the operator's workmanship.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A trimming apparatus for a cigarette manufacturing machine providing a cut tobacco layer on a tobacco band which travels with the cut tobacco layer in one direction, and a continuous cigarette rod being formed from the cut tobacco layer and a paper web, said trimming apparatus comprising:

a rotatable trimming disk having a peripheral edge portion and a plurality of pockets on the peripheral edge portion, a cut tobacco layer being receivable in the pockets to form thickened portions in the cut tobacco layer at intervals each corresponding to a length of each cigarette;

means for cutting a cigarette rod into individual cigarettes;

means for outputting cutting signals when the cigarette rod is cut into individual cigarettes by the means for cutting;

drive means for rotating the trimming disk, said drive means including a power transmission line extending up the trimming disk; and synchronizing means for adjusting a rotational phase of the pockets of the trimming disk to the outputted cutting signals during operation of said cigarette manufacturing machine so that the formed cigarette rod is cut in respective centers of specific portions corresponding individually to the thickened portions of the cut tobacco layer, wherein said synchronizing means includes an input shaft located in the power transmission line of said drive means and receiving power, an output shaft for delivering the power to said trimming disks, planetary gear means for transmitting a rotational force of the input shaft to the output shaft, and adjusting means for changing a rotational phase of the output shaft with respect to that of the input shaft, wherein the input and output shafts are arranged on a same axis, and the planetary gear means includes a carrier mounted on the input shaft, a sun gear mounted on the output shaft, a ring gear surrounding the sun gear and supported for rotation, the ring gear having internal teeth, a plurality of gear shafts projecting from the carrier and extending in a space between the sun gear and the ring gear, and a plurality of planetary gears mounted individually on the gear shafts for rotation and in mesh with the sun gear and the internal teeth of the ring gear, wherein the adjusting means includes second drive means for rotating the ring gear in a forward or reverse direction, wherein said second drive means includes a reversible servomotor, a second power transmission line for transmitting a rotational force from the servomotor to the ring gear, computing means for computing a distance between each cutting position of the cigarette rod and the central position of each corresponding specific portion, and control means for rotating the servomotor in accordance with the computer distance and adjusting a rotational angle of the ring gear by means of the second power transmission line, and wherein the second power transmission line includes a gear formed on an outer peripheral surface of the ring gear and a worm in mesh therewith.

2. The apparatus according to claim 1, wherein said second drive means further includes an upstream portion on the servomotor side of the second power transmission line, a downstream portion on the ring gear side, and clutch means for separably connecting the upstream and downstream portions of the second transmission line.

3. The apparatus according to claim 2, wherein said second drive means further includes a manual handle for rotating the worm.

4. The apparatus according to claim 1, further comprising detecting means for detecting cutting positions of the formed cigarette rod and the respective central positions of the specified portions, respectively, and display means for displaying the detected cutting positions and the central positions of the specific portions.

* * * * *